US005927260A

United States Patent [19]

Kishimoto et al.

[11] Patent Number: 5,927,260

[45] Date of Patent: Jul. 27, 1999

[54] DEVICE FOR DIAGNOSING OXYGEN SENSOR DETERIORATION

[75] Inventors: Youichi Kishimoto, Brussels, Belgium; Akio Katayama, Yokohama, Japan

[73] Assignee: Nissan Motor Co., Ltd., Yokohama, Japan

[21] Appl. No.: 08/949,324

[22] Filed: Oct. 3, 1997

[30] Foreign Application Priority Data

Oct. 3, 1996 [JP] Japan ..... 8-262688

[51] Int. Cl.[6] ..... F02D 41/14

[52] U.S. Cl. ..... 123/688; 123/696; 73/23.32; 73/117.3; 60/276; 60/277

[58] Field of Search ..... 60/276, 277; 123/688, 123/696; 73/23.32, 117.3

[56] References Cited

U.S. PATENT DOCUMENTS

| | | | |
|---|---|---|---|
| 4,402,217 | 9/1983 | Higashiyama | 73/117.3 |
| 4,625,698 | 12/1986 | Jamrog | 123/489 |
| 5,007,398 | 4/1991 | Kashiwabara | 73/117.3 |
| 5,227,975 | 7/1993 | Nakaniwa | 123/696 |
| 5,370,101 | 12/1994 | Hamburg et al. | 123/688 |
| 5,610,321 | 3/1997 | Shinmoto | 73/23.32 |
| 5,656,765 | 8/1997 | Gray | 60/276 |
| 5,672,817 | 9/1997 | Sagisaka et al. | 73/117.3 |

FOREIGN PATENT DOCUMENTS

| | | |
|---|---|---|
| 61-192832 | 8/1986 | Japan . |
| 62-147034 | 7/1987 | Japan . |

*Primary Examiner*—Erick R. Solis
*Attorney, Agent, or Firm*—Foley & Lardner

[57] ABSTRACT

The air/fuel ratio of an engine is feedback controlled based upon the output of an oxygen sensor. The control includes proportional control and also correction of a control variable for this proportional control according to the actual air/fuel ratio. The period of the output signal of the oxygen sensor during feedback control is measured, a decision value is set corresponding to change in the control variable, and deterioration of the oxygen sensor is determined by comparing the period of the output signal with the decision value. By doing this, change in the control variable is prevented from exerting any influence upon the period of the output signal of the oxygen sensor, and the accuracy of deterioration diagnosis for the oxygen sensor is enhanced.

9 Claims, 3 Drawing Sheets

DEVICE FOR DIAGNOSING OXYGEN SENSOR DETERIORATION

FIELD OF THE INVENTION

This invention relates to deterioration diagnosis for an oxygen sensor which is used in air/fuel ratio feedback control for an engine.

BACKGROUND OF THE INVENTION

As a method of deterioration diagnosis for an oxygen sensor which is used in feedback control for the air/fuel ratio of an engine, a method of diagnosing deterioration of the oxygen sensor based upon the period of air/fuel ratio variations detected by the oxygen sensor is disclosed for example in Tokkai Sho 61-192832 published by the Japanese Patent Office in 1986. According to this method, the period, according to which the air/fuel ratio varies upwards from rich to lean past the stoichiometric air/fuel ratio and in the reverse direction, is measured from the output of the oxygen sensor, and this measured period is compared with the period characteristic of steady operation of the engine which is determined in advance; and it is deemed that deterioration of the oxygen sensor has occurred if the former is greater than the latter.

In other words, deterioration of the oxygen sensor which detects the air/fuel ratio is determined from the responsiveness of the actual air/fuel ratio to air/fuel ratio control.

Certain control variables must be determined appropriately in order to obtain desirable control responsiveness for the air/fuel ratio feedback control of the engine. In this connection, it is disclosed in Tokkai Sho 62-147034 published by the Japanese Patent Office in 1987 to provide oxygen sensors both upstream and downstream of a catalytic converter which purifies the exhaust gas of the engine, and to perform air/fuel ratio feedback control based upon the output of the oxygen sensor on the upstream side, while on the other hand varying the control variables for this control based upon the output of the oxygen sensor on the downstream side.

In this case, the period of variation of the air/fuel ratio as detected by the upstream side sensor is affected by change of the control variables. Accordingly, with this type of air/fuel ratio feedback control apparatus, if diagnosis of deterioration of the oxygen sensor is performed from the period of variation of the air/fuel ratio, it is difficult to provide a sufficiently accurate diagnosis.

SUMMARY OF THE INVENTION

It is therefore an object of this invention to eliminate any influence which control variables may exert upon deterioration diagnosis for an oxygen sensor.

It is a further object of this invention, in deterioration diagnosis for an oxygen sensor, to eliminate any other cause of adverse influence exerted upon the diagnosis.

In order to achieve the above objects, this invention provides a device for diagnosing deterioration of an oxygen sensor used in an engine which, based upon the output signal of the oxygen sensor, performs feedback control of air/fuel ratio and correction of a control variable for the control.

The device comprises a microprocessor programmed to measure a period of the output signal of the oxygen sensor during the feedback control of air/fuel ratio, set a decision value corresponding to change in the control variables, and determine deterioration of the oxygen sensor by comparing the period of the output signal with the decision value.

It is preferable that the device further comprises a sensor which detects the rotational speed of the engine, and that the microprocessor is further programmed to correct the period of the oxygen sensor output signal based upon the engine rotational speed.

It is also preferable that the device further comprises a mechanism for detecting an engine operational state, and that the microprocessor is further programmed to determine from the engine operational state whether or not the oxygen sensor is activated, and not to determine whether or not the oxygen sensor has deteriorated if the oxygen sensor is not activated.

It is also preferable that the microprocessor is further programmed to measure a period of the output signal of the oxygen sensor over a plurality of cycles, and to use the average value of the measured values as the period of the output signal for the deterioration determination.

It is also preferable that the microprocessor is further programmed to set the decision value as a range which has an upper limit value and a lower limit value, and to determine that the oxygen sensor has deteriorated if the output signal period falls outside the range.

It is also preferable that the feedback control of air/fuel ratio includes proportional control and the control variable is a variable for the proportional control.

According to another aspect of this invention, the device comprises a microprocessor programmed to measure a period of the output signal of the oxygen sensor during the feedback control of air/fuel ratio, determine deterioration of the oxygen sensor by comparing the period of the output signal with a predetermined decision value, and prevent the determination if a difference between the control variable after correction and a predetermined standard value is greater than a predetermined value.

This invention also provides a device for diagnosing deterioration of an oxygen sensor used in an engine which comprises a catalytic converter which purifies exhaust gas of the engine, a first oxygen sensor which detects the oxygen concentration in the exhaust gas upstream of the catalytic converter, and a second oxygen sensor which detects the oxygen concentration in the exhaust gas downstream of the catalytic converter, and which on the one hand performs feedback control of air/fuel ratio based upon the output signal of the first oxygen sensor, and on the other hand corrects a control variable for the control based upon the output signal of the second oxygen sensor.

The device comprises a microprocessor programmed to measure a period of the output signal of the first oxygen sensor during the feedback control of air/fuel ratio, set a decision value corresponding to change in the control variable and determine deterioration of the first oxygen sensor by comparing the period of the output signal with the decision value.

The details as well as other features and advantages of this invention are set forth in the remainder of the specification and are shown in the accompanying drawings.

DESCRIPTION OF THE PREFERRED EMBODIMENT

Figure 1:
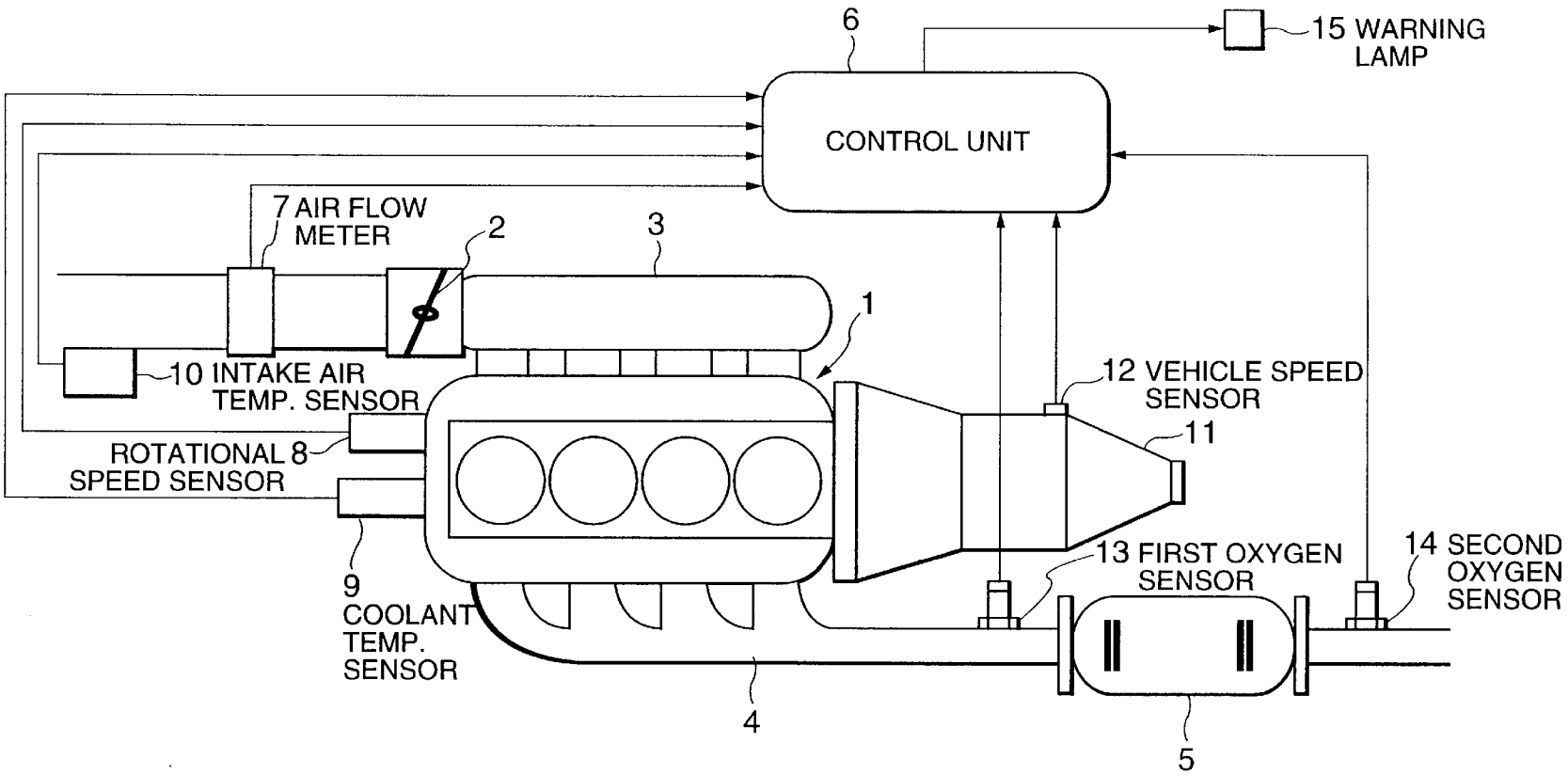
FIG. 1 is a schematic structural diagram of a deterioration diagnosis device according to this invention.

Referring to FIG. 1 of the drawings, an engine 1 for use in a vehicle inhales air, the flow amount of which is controlled by a throttle valve 2, through an intake manifold 3. A fuel injection valve not shown in the figures injects fuel into this inhaled air. The mixture of air and fuel produced in this manner is combusted within the engine 1, and the gases produced by this combustion are exhausted from an exhaust manifold 4 through a catalytic converter 5 into the atmosphere. The output torque of the engine 1 is transmitted via a transmission 11 to the driving wheels of the vehicle at a predetermined speed change ratio.

Figure 3:
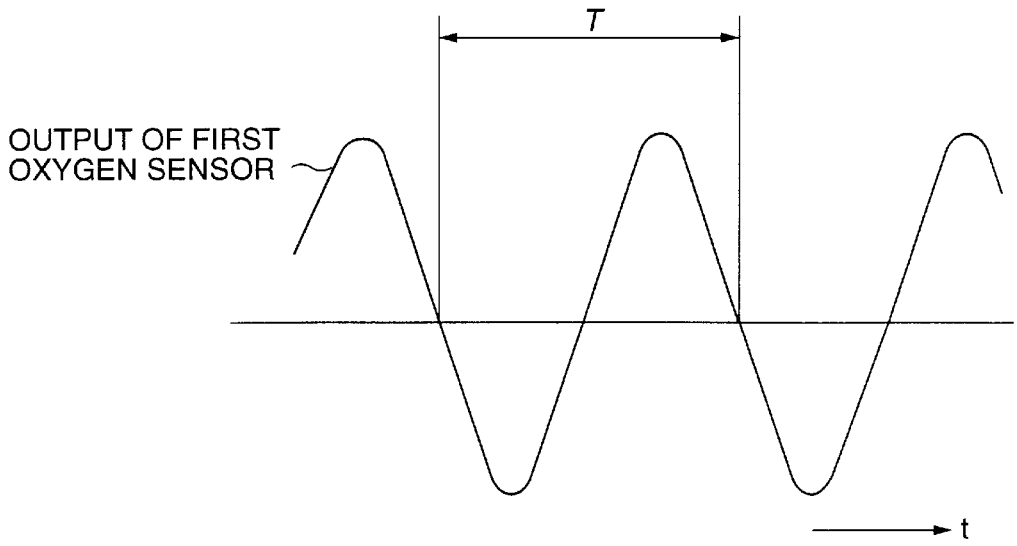
FIG. 3 is a timing chart showing the output waveform of the oxygen sensor, detected by this deterioration diagnosis device.

The amount of fuel injected by the fuel injection valve is controlled by a control unit 6 which may for example comprise a microcomputer. In order to do this the control unit 6 receives input signals from: an air flow meter 7 which detects the amount Qa of air inhaled by the engine 1; a rotational speed sensor 8 which detects the rotational speed Ne of the engine 1 from the rotational speed of the cam shaft or of the crank shaft thereof; a coolant temperature sensor 9 which detects the temperature of the coolant of the engine 1; an intake air temperature sensor 10 which detects the temperature of the air inhaled by the engine 1; a vehicle speed sensor 12 which detects the vehicle speed from the rotational speed of the output shaft of the transmission 11; a first oxygen sensor 13 which detects the concentration of oxygen in the exhaust gas upstream of the catalytic converter 5; and a second oxygen sensor 14 which detects the concentration of oxygen in the exhaust gas downstream of the catalytic converter 5. The oxygen sensors 13 and 14 output voltage signals which, as shown in FIG. 3, are representative of the concentrations of oxygen in the exhaust gas at the points in the exhaust system where they are respectively located.

The control unit 6 calculates a basic fuel injection amount Tp based upon the amount Qa of inhaled air and the engine rotational speed Ne. And it sets an air/fuel ratio feedback coefficient $\alpha$ based upon the oxygen concentrations in the exhaust gas which are detected by the first and second oxygen sensors 13 and 14. Further, it sets various correction coefficients CO based upon the coolant temperature and the like. Yet further, it sets a voltage correction value Ts according to the battery output voltage. Then it determines a final fuel injection amount Ti according to the following correction equation:

$$Ti=Tp\cdot\alpha\cdot CO+Ts$$

And the control unit 6 outputs a signal of pulse width corresponding to this final fuel injection amount Ti to the fuel injection valve at a timing synchronized with the rotation of the engine 1. By doing this, the fuel injection valve is caused to inject this amount Ti of fuel.

The control unit 6 sets the air/fuel ratio feedback coefficient $\alpha$ according to the following procedure.

First, it compares the output signal (the output voltage) of the first oxygen sensor 13 with a slice level which corresponds to the target air/fuel ratio, and determines whether the air/fuel ratio of the mixture gas which is being supplied to the engine 1 is rich or is lean in comparison to the target air/fuel ratio.

If the supplied air/fuel ratio is rich, then the control unit 6 reduces the correction coefficient $\alpha$ by a predetermined integration variable IR each time fuel is injected, until the air/fuel ratio determined by the first oxygen sensor 13 becomes lean. When the air/fuel ratio becomes lean, then it increases the correction coefficient $\alpha$ by a predetermined proportional variable PL. Thereafter, it increases the correction coefficient $\alpha$ by a predetermined integration variable IL each time fuel is injected, until the air/fuel ratio again becomes rich. When the air/fuel ratio becomes rich, first the control unit 6 reduces the correction coefficient $\alpha$ by a predetermined proportional variable PR, and thereafter it reduces the correction coefficient $\alpha$ by the aforesaid integration variable IR each time fuel is injected, until the air/fuel ratio becomes lean.

By repeating the above described proportional/integration control process, the actual air/fuel ratio is maintained in the vicinity of the target air/fuel ratio. It should be noted that the initial value of the correction coefficient $\alpha$ is set to 1.0, which corresponds to the stoichiometric air/fuel ratio.

The control unit 6 further performs correction of the variables of proportion PL and PR. In order to do this, it compares the output signal of the second oxygen sensor 14 with the aforesaid slice level, and determines whether the air/fuel ratio which this output signal indicates is rich or is lean in comparison to the target air/fuel ratio. The output of this second oxygen sensor 14 which is provided downstream of the catalytic converter 5 has the distinguishing feature that its responsiveness is low so that its stability is high, in comparison with the output of the first oxygen sensor 13. Thus it is appropriate to use the output of the second oxygen sensor 14 for determining whether the actual air/fuel ratio tends to be lean or tends to be rich, in order to correct the variables of proportion PL and PR.

If the basic values of the variables of proportion PL and PR are respectively termed $PL_B$ and $PR_B$, then this correction of these variables of proportion PL and PR is performed by respectively increasing and decreasing them by a correction amount PHOS, according to the following equations:

$$PL=PL_B+PHOS$$

$$PR=PR_B-PHOS$$

In more detail, if the output signal from the second oxygen sensor 14 indicates lean, then the correction amount PHOS is taken as positive. By doing this, the variable of proportion PL is increased, while the variable of proportion PR is decreased. As a result, the central point for the air/fuel ratio control is shifted towards rich.

On the other hand, if the output signal from the second oxygen sensor 14 indicates rich, then the correction amount PHOS is taken as negative. By doing this, the variable of proportion PL is decreased, while the variable of proportion PR is increased. As a result, the central point for the air/fuel ratio control is shifted towards lean.

The above procedure for air/fuel ratio control is per se known from, for example, the abovementioned Japanese Tokkai Sho 62-147034.

Figure 2:
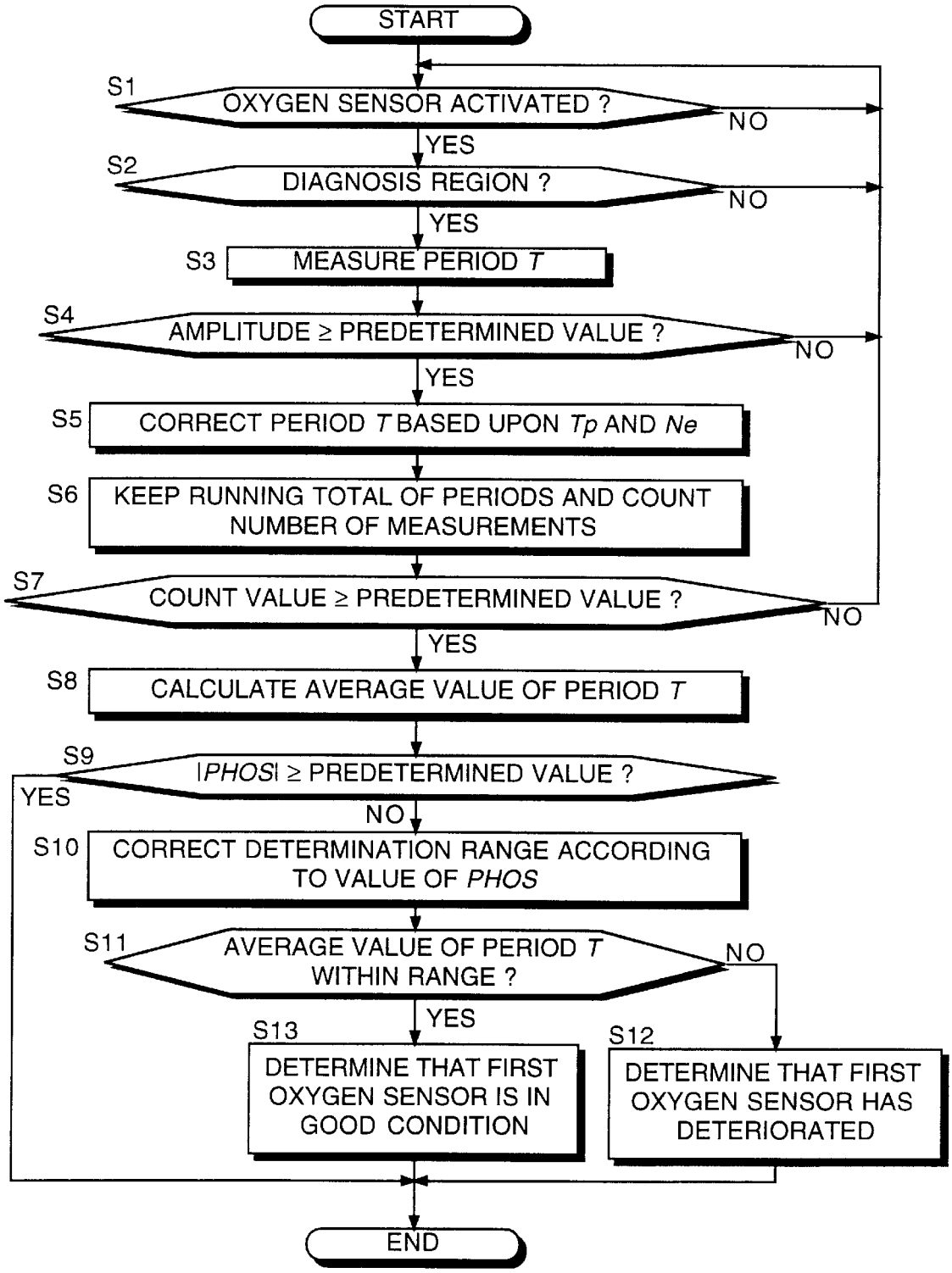
FIG. 2 is a flow chart for explanation of a deterioration diagnosis process executed by this deterioration diagnosis device.

Now, in an engine of the above structure, the control unit 6 detects deterioration of the first oxygen sensor 13, according to the present invention, by a procedure whose flow chart is shown in FIG. 2.

First, in a step S1, a decision is made as to whether or not the first oxygen sensor 13 is activated. This is done by comparing the temperature of the element of this first oxygen sensor 13 with a predetermined activation temperature. The element temperature of the first oxygen sensor is estimated based upon various vehicle operating conditions, such as the load upon the engine 1 which is represented by the basic fuel injection amount Tp, the engine coolant temperature, the vehicle speed, the external air temperature, etc. Alternatively, it would be possible to provide a sensor for detecting the catalyst temperature of the catalytic converter 5, and to estimate the temperature of the element of the oxygen sensor 13 from this catalyst temperature. Yet further, it would also be possible to estimate the temperature of the element of the oxygen sensor 13 based upon the catalyst temperature, which was itself estimated from various vehicle operating conditions.

If the first oxygen sensor 13 is activated, then in a step S2 a decision is made as to whether or not the operating conditions of the vehicle have entered into a diagnosis region which is set in advance.

This decision as to whether or not the vehicle operating conditions are within this diagnosis region is performed by determining whether or not the basic fuel injection amount Tp which is taken as representative of the load upon the engine, the engine rotational speed Ne, and the vehicle road speed are all of them individually within predetermined ranges. This diagnosis region is included within the region of the vehicle operating conditions in which air/fuel ratio feedback control is performed, and moreover is set to be more restricted than said feedback control region. Accordingly it is ensured that, whenever it is determined that the vehicle operating conditions fall within this diagnosis region, air/fuel ratio feedback control is certainly being performed.

If the vehicle operating conditions do indeed fall within this diagnosis region, then as shown in FIG. 3 the period T of the output voltage of the first oxygen sensor 13 is measured in a step S3.

In a step S4, a decision is made as to whether or not the amplitude of the output voltage of the first oxygen sensor 13 is at least equal to a predetermined value. And, if this amplitude is less than said predetermined value, it is deemed that the measurement of the period T has not been performed accurately, and the flow of control returns to the step S1 so as to restart the process of FIG. 2 from the beginning.

On the other hand, if the output signal amplitude is greater than or equal to the predetermined value, then in a step S5 the period T is corrected based upon the basic fuel injection amount Tp and the engine rotational speed Ne. This is done in order to correct for variations of the period T which accompany changes in the engine load and in the engine rotational speed.

The period T and the frequency are strongly influenced by the speed of flow of the exhaust gases of the engine: the higher is the exhaust gas flow speed, the shorter is the period T, in other words the higher is the frequency. Further, the exhaust gas flow speed is correlated with the engine rotational speed. Therefore, when the engine rotational speed is high, the engine exhaust gas flow speed is high and the increase correction should be applied to the period T, while on the other hand, when the engine rotational speed is low, the engine exhaust gas flow is low and the decrease correction should be applied to the period T.

On the other hand, although the influence which the load on the engine exerts upon the period T is comparatively small, nevertheless at high engine load the temperature of the first oxygen sensor 13 becomes high and its responsiveness is thereby enhanced, so that the period T becomes smaller. Thus, at times of high engine load, the period T should be corrected by being increased.

However, the engine rotational speed has a greater influence upon the period T than does the engine load, and therefore it would be acceptable only to correct the period T based upon the engine rotational speed.

In a step S6, along with keeping a running total of the values of the period T after correction, a count is kept of the number of times that the period T is measured.

In a step S7, a decision is made as to whether or not this count value has attained a predetermined value, and if it has not yet attained the predetermined value then the flow of control is returned to the step S1 and the above described procedure is repeated.

If the count value has attained the predetermined value, then in a step S8 the average value of the period T is obtained by dividing the total of all the values of the period T by the number of times this period T was measured. This is a measure for preventing deterioration diagnosis of the first oxygen sensor 13 from being performed based upon instantaneous changes of the period T. Of course, it would also be possible to substitute the frequency for the period T, and to perform deterioration diagnosis based upon the frequency.

In a step S9, the absolute value of the correction amount PHOS for the above described variables of proportion PL and PR is compared with predetermined values. If the absolute value of the correction amount PHOS is greater than the predetermined value, then the variables of proportion PL and PR are very considerably corrected, and therefore the variation of the period T is great. In this case it is inappropriate to diagnose deterioration of the first oxygen sensor 13 from the period T, and accordingly this routine is terminated without performing any such diagnosis.

On the other hand, if the absolute value of the correction amount PHOS is less than the predetermined value, then the flow of control proceeds to a step S10. Here the permitted range for the period T for determination of deterioration of the first oxygen sensor 13 is corrected according to the value of the correction amount PHOS.

For example, it will be supposed that the ratio of the basic values $PL_B$ and $PR_B$ of these variables of proportion PL and PR were originally 5:5, and that after the correction process the ratio of PL and PR becomes 9:1 or 1:9.

Figure 4:
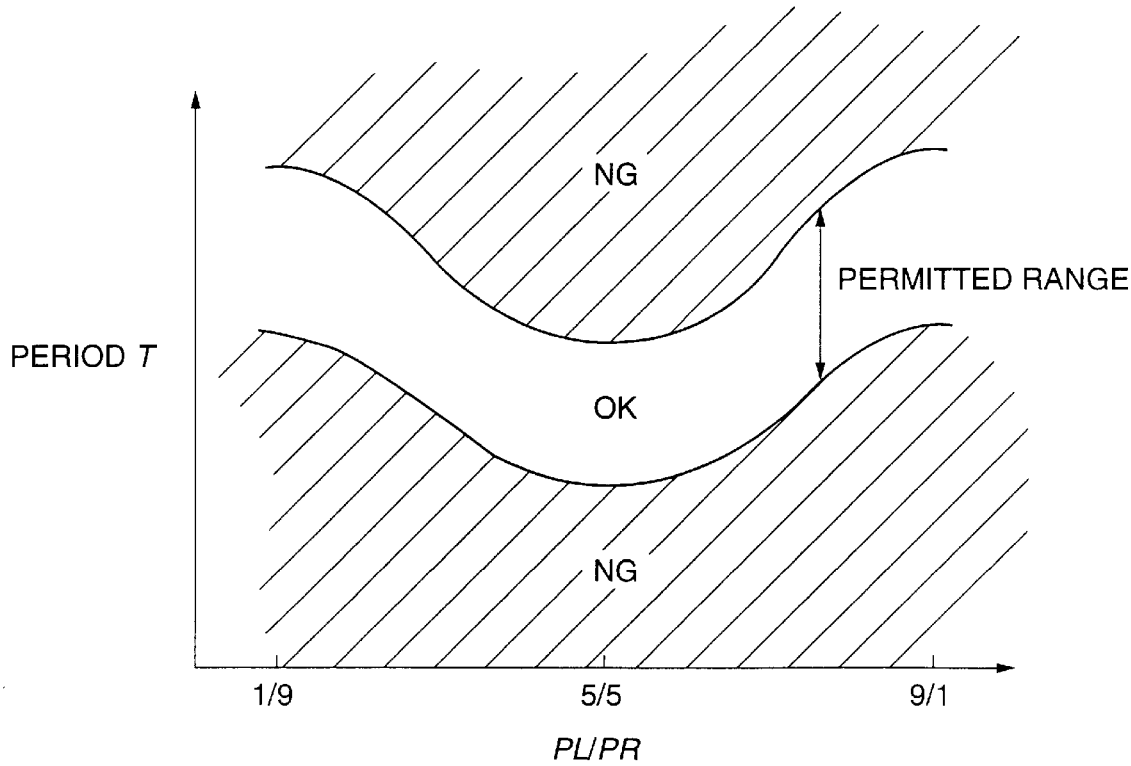
FIG. 4 is a diagram for explanation of the relationship between variables of proportion and a permitted range for a period T, predetermined for this deterioration diagnosis device.

As shown in FIG. 4, it has been verified in experiments which have been performed by the present inventors that, the more does the balance of the variables of proportion PL and PR change in this manner, the greater does the value of the period T become. In this figure, the range of the period which is shown as the permitted range shows the range of the period T which is applied to deterioration determination of the first oxygen sensor 13.

In a step S10, accordingly, the greater is the absolute value of the correction amount PHOS, the more is the permitted range for the period T corrected by being shifted in the direction of increasing the period.

It should be noted that it would be acceptable to eliminate the step S9, if in the step S10 the accuracy of diagnosis could be ensured by correcting the permitted range, even if the absolute value of the correction amount PHOS in the step S9 were greater than the predetermined value.

In a step S11, a decision is made as to whether or not the average value of the period T which was measured in the step S8 falls within the permitted range which was corrected in the step S10.

If indeed this average period does fall within the permitted range, then in a step S13 it is deemed that the first oxygen sensor 13 is in good condition. On the other hand, if the average period falls outside the permitted range, then in a step S12 it is deemed that the first oxygen sensor 13 has deteriorated. Desirably a warning light 15 is connected to the control unit as shown in FIG. 1, and this warning light 15 is illuminated when oxygen sensor deterioration has been detected in the step S12.

Thus as described above it is possible to eliminate the influence which changes of the variables of proportion PL and PR exert upon the period T, by correcting the permitted range for the period T with respect to such changes in these variables of proportion.

Further, it is possible to eliminate the influence which changes of rotation speed of the engine exert upon the period T by correcting the period T which has been measured for the engine rotation speed Ne.

Yet further, it is possible to prevent the problem of erroneous diagnosis of deterioration of the first oxygen sensor 13 caused by low frequency output of the first oxygen sensor 13 when it is not activated, by performing diagnosis after having checked that the first oxygen sensor 13 is indeed activated.

The embodiments of this invention in which an exclusive property or privilege is claimed are defined as follows:

1. A device for diagnosing deterioration of an oxygen sensor used in an engine which, based upon the output signal of said oxygen sensor, performs feedback control of air/fuel ratio and correction of a control variable for said control, said device comprising a microprocessor programmed to:

measure a period of the output signal of said oxygen sensor during the feedback control of air/fuel ratio;

set a decision value corresponding to change in said control variable; and determine deterioration of said oxygen sensor by comparing the period of said output signal with said decision value.

2. A deterioration diagnosis device according to claim 1, further comprising a sensor which detects the rotational speed of said engine, and wherein said microprocessor is further programmed to correct said period of said oxygen sensor output signal based upon the engine rotational speed.

3. A deterioration diagnosis device according to claim 1, further comprising a mechanism for detecting an engine operational state, and wherein said microprocessor is further programmed to determine from said engine operational state whether or not said oxygen sensor is activated, and not to determine whether or not said oxygen sensor has deteriorated if said oxygen sensor is not activated.

4. A deterioration diagnosis device according to claim 1, wherein said microprocessor is further programmed to measure a period of the output signal of said oxygen sensor over a plurality of cycles, and to use the average value of said measured values as the period of said output signal for said deterioration determination.

5. A deterioration diagnosis device according to claim 1, wherein said microprocessor is further programmed to set said decision value as a range which has an upper limit value and a lower limit value, and to determine that said oxygen sensor has deteriorated if said output signal period falls outside said range.

6. A deterioration diagnosis device according to claim 1, wherein said feedback control of air/fuel ratio includes proportional control and said control variable is a variable for the proportional control.

7. A device for diagnosing deterioration of an oxygen sensor used in an engine which, based upon the output signal of said oxygen sensor, performs feedback control of air/fuel ratio and correction of a control variable for said control, said device comprising a microprocessor programmed to:

measure a period of the output signal of said oxygen sensor during the feedback control of air/fuel ratio;

determine deterioration of said oxygen sensor by comparing the period of said output signal with a predetermined decision value; and prevent said determination if a difference between said control variable after correction and a predetermined standard value is greater than a predetermined value.

8. A device for diagnosing deterioration of an oxygen sensor used in an engine which comprises a catalytic converter which purifies exhaust gas of the engine, a first oxygen sensor which detects the oxygen concentration in the exhaust gas upstream of said catalytic converter, and a second oxygen sensor which detects the oxygen concentration in the exhaust gas downstream of said catalytic converter, and which on the one hand performs feedback control of air/fuel ratio based upon the output signal of said first oxygen sensor, and on the other hand corrects a control variable for said control based upon the output signal of said second oxygen sensor, said device comprising a microprocessor programmed to:

measure a period of the output signal of said first oxygen sensor during the feedback control of air/fuel ratio;

set a decision value corresponding to change in said control variable; and determine deterioration of said first oxygen sensor by comparing the period of said output signal with said decision value.

9. A device for diagnosing deterioration of an oxygen sensor used in an engine which, based upon the output signal of said oxygen sensor, performs feedback control of air/fuel ratio and correction of a control variable for said control, said device comprising:

means for measuring a period of the output signal of said oxygen sensor during the feedback control of air/fuel ratio;

means for setting a decision value corresponding to change in said control variable; and means for determining deterioration of said oxygen sensor by comparing the period of said output signal with said decision value.

* * * * *